United States Patent [19]

Stirling

[11] Patent Number: 4,481,749

[45] Date of Patent: Nov. 13, 1984

[54] PANELLING CLIP AND METHOD

[76] Inventor: Wilson M. Stirling, 11 Beenak Ave., East Brighton, Victoria, Australia

[21] Appl. No.: 355,738

[22] PCT Filed: Jul. 1, 1981

[86] PCT No.: PCT/AU81/00081

§ 371 Date: Mar. 2, 1982

§ 102(e) Date: Mar. 2, 1982

[87] PCT Pub. No.: WO82/00180

PCT Pub. Date: Jan. 21, 1982

[30] Foreign Application Priority Data

Jul. 2, 1980 [AU] Australia ..... PE4343

[51] Int. Cl.[3] ..... E04B 1/38; E04C 2/00

[52] U.S. Cl. ..... 52/714; 52/489; 52/509; 52/715; 52/775; 52/DIG. 6

[58] Field of Search ..... 52/483, 479, 489, 281, 52/509, DIG. 6, 714, 481, 774, 775; 403/187; 248/222.3

[56] References Cited

U.S. PATENT DOCUMENTS

| | | | |
|---|---|---|---|
| 2,200,649 | 5/1940 | Warole | 52/DIG. 6 |
| 2,857,995 | 10/1958 | Boulton | 52/483 X |
| 3,038,571 | 6/1962 | Clements | 52/512 X |
| 3,331,180 | 7/1967 | Vissing et al. | 52/714 |
| 3,577,694 | 5/1971 | Omholt | 52/489 |
| 4,377,060 | 3/1983 | Ragland | 52/489 |

FOREIGN PATENT DOCUMENTS

| | | | |
|---|---|---|---|
| 146282 | 1/1951 | Australia . | |
| 244692 | 4/1963 | Australia . | |
| 254669 | 5/1963 | Australia . | |
| 11351 | 3/1968 | Australia . | |
| 21098 | 11/1968 | Australia . | |
| 46000 | 2/1974 | Australia . | |
| 2658589 | 7/1977 | Fed. Rep. of Germany | 52/489 |
| 594142 | 12/1977 | Fed. Rep. of Germany . | |
| 2385856 | 10/1978 | France . | |
| 2456816 | 1/1981 | France | 52/509 |
| J20 | 10/1932 | New Zealand . | |
| 185806 | 5/1981 | New Zealand . | |
| 572564 | 2/1976 | Switzerland | 52/483 |
| 13875 | 12/1977 | Switzerland . | |

*Primary Examiner*—John E. Murtagh
*Assistant Examiner*—Michael Safavi
*Attorney, Agent, or Firm*—Price, Heneveld, Huizenga & Cooper

[57] ABSTRACT

A panelling clip for fixing tongue and groove boards comprises a main body 14 to engage against the front face of the re-entrant flanges 26 of a channel 24. An integral plate 18 extends rearwardly from the main body 14 and has laterally projecting tabs 20 with sharp edges 21 to grip the rear faces of the flanges 26. A platform 13 integral with the main body 14 extends forwardly thereform and has downwardly projecting tabs 12. In use tongue and groove boards are placed against spaced parallel channels and clips are fitted and pressed into engagement with the board grooves alternating with the boards.

4 Claims, 3 Drawing Figures

FIG. 1.
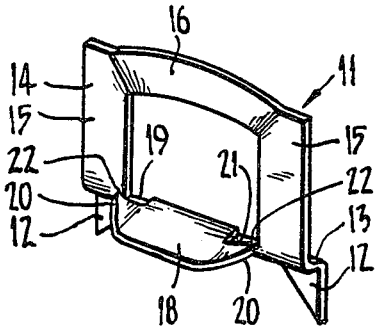
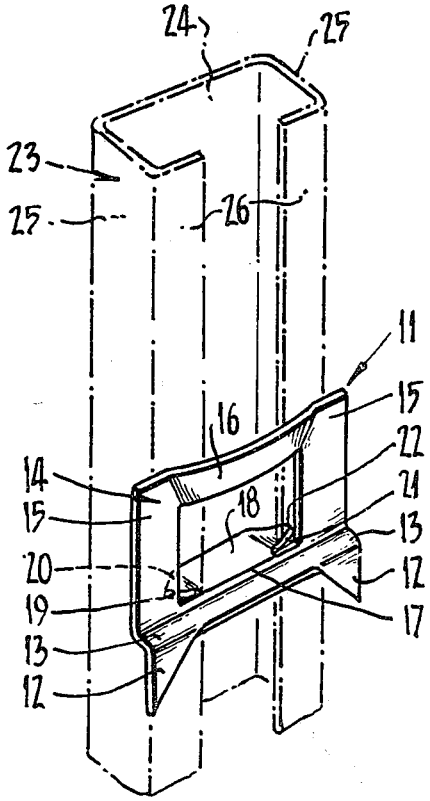
FIG. 2.
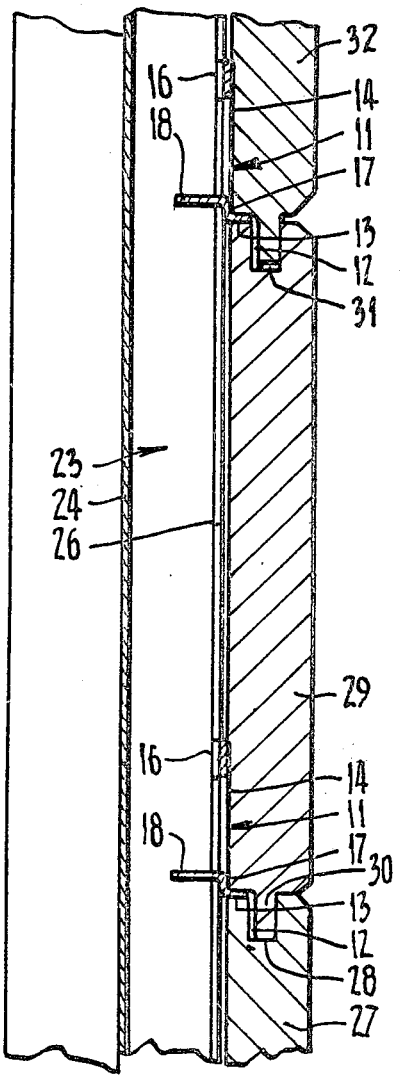
FIG. 3.

PANELLING CLIP AND METHOD

TECHNICAL FIELD

This invention relates to a panelling clip and is concerned more particularly with a clip for fixing tongue and groove boards for the panelling of walls, and a method incorporating the use of such clips.

BACKGROUND ART

The traditional method of fixing tongue and groove boards for wall panelling involves nailing of the boards but this is not always a desirable practice and there is therefore a need for procedures whereby panels can be fixed in position without nailing being apparent and also so that if required the panelling may be wholly or partially disassembled, e.g., to provide access to the space behind the panelling. A particular problem experienced where boards are not firmly nailed is that the boards tend to bow, resulting in an unsightly appearance.

It is an object of the present invention to provide a clip, and a method involving the use of a quantity of such clips, whereby panelling can be carried out expeditiously and cheaply, without resulting in the appearance of nail heads or other fixing means, and whereby the boards of the panelling are held firmly in position and bowing or other distortion is minimised.

DISCLOSURE OF THE INVENTION

With this object in view one aspect of the invention broadly resides in the provision and utilisation of clips which are constructed to engage upon an edge of a timber board and which are further constructed to move slidably relative to a supporting structure and to engage firmly with said supporting structure to retain boards with which they are engaged.

More particularly a clip according to the invention may comprise a body constructed to be engaged with a channel or like supporting member, said clip having one portion which in use is disposed within the supporting member for the purpose of gripping a surface thereof, and another portion which in use extends outwardly of the supporting member and is constructed to engage upon the edge of a timber board.

Other objects and features of the invention will be apparent from the following description of a preferred form thereof made with reference to the accompanying drawings.

BRIEF DESCRIPTION OF DRAWINGS

FIG. 1 is a perspective view of a clip according to this preferred form of the invention.

FIG. 2 is a perspective view of the clip of FIG. 1, seen from a different direction and positioned on a supporting channel shown in dotted outline, and FIG. 3 is a cross-sectional view of part of a pannelled wall showing a channel with two clips according to FIGS. 1 and 2 in conjunction with timber boards.

BEST MODE OF CARRYING OUT THE INVENTION

Referring to the drawings a clip 11 is shown in FIGS. 1 and 2, and two such clips are shown in FIG. 3. The clip 11 is made of suitable spring steel sheet of a suitable gauge, normally 26 gauge. It is made by punching out a piece of the material which is generally rectangular with two triangular projecting tabs 12 at opposite ends of one edge. These tabs 12 are bent in the line of that edge into a plane at right angles to the piece, which is also bent at right angles in the reverse direction, along a line parallel to and close to the same edge. This results in the main body 14 of the clip extending generally parallel to the plane of the tabs 12 and joined to them by an intermediate region 13 hereinafter termed the platform. The said main body 14 is partially cut away centrally to leave two side-pieces 15 which extend from the platform 13 and are joined by a cross-piece 16. The cross-piece 16 is bowed convexly towards the plane of the tabs 12. Part of the material cut out from the main body 14 is left joined to the platform 13 and is bent at right angles towards the side opposite from the platform and in a plane slightly spaced from it in the direction of the cross-piece 16. Hence this remaining part results in a tranverse rib 17 extending along the edge of the platform 13 between the side-pieces 15, and an integral plate 18 joined to the edge of the rib 17. At each end of the plate 18, in the transverse direction of the clip 11, a slot 19 is cut thereby leaving two tabs 20 with sharp edges 21 along the sides of the slots 19 and sharp points 22 at the outer ends thereof. As shown in FIGS. 1 and 2 these terminal tabs 20 are bent slightly through an angle of about 5° in the direction towards the cross-piece 16. The function of the edges 21 and points 22 is to engage against the internal edge of a supporting channel 23 which is shown in dotted outline in FIG. 2 and in cross-section in FIG. 3. The channel 23 has a web 24, with side flanges 25 and re-entrant flanges 26, suitable dimensions being 20 mm internally for the web 24, 10 mm internally for the side flanges 25, and 4 mm internally for the re-entrant flanges 26. The channel 23 is preferably extruded from a suitable plastics material and the thickness of the web and the flanges is about 24 gauge.

The dimensions of the clip 11 are related to those of the channel 23 so that the plate 18 can be inserted between the flanges 22 and the clip then turned, in the plane of the main body 14, to bring the edges 21 and points 22 behind the flanges 26, as seen in FIGS. 2 and 3. The length of the neck of material between the ends of the slots 29 is short enough to fit between the channel flanges 26, and the width of the slots 19 is slightly greater than the thickness of the channel flanges 26. The overall width of the clip is not of particular importance and may approximate to the width of the channel. The space between the planes of the tabs 12 and the side pieces 15 of the main body 14 is related to the thickness and the tongue and groove arrangement of the timber boards used with the clips, as will be hereinafter apparent.

In use, a plurality of the channels 23 are fixed in position, parallel to each other and with the re-entrant flanges 26 of each all in the one plane, the direction of each channel 23 being at right angles to the intended direction of the panelling. Thus where the panelling boards are to be placed horizontally the channels 23 are fixed vertically on the wall studs or like frame work, and where the panelling boards are to extend vertically the channels are fixed so that they extend horizontally.

After fixing the channels in position the first panelling board is laid, with a grooved edge facing in the direction from which the next board is to be applied and a plurality of the clips 11 are then applied, one in each of the channels 23. Taking an example in which the boards are laid horizontally, and with reference to FIG. 3, an upper part of the first board 27 as shown engaged by one of the first group of clips 11, the clip being engaged with the channel 23 and having its platform 13 pressed down upon the grooved edge of the board 27 with the tabs 12 inserted in the groove 28 of the board. As stated above, the dimensions of the clip are related to those of the board and preferably the arrangement is such that in fitting the tabs into the groove the main body 14 is drawn away from the outer face of the channel flanges 26 to a slight extent and the edges 21 and points 22 are held against the inner face by a force dependent upon the resilience of the board 27. This will enable the board to be held against rising and for any bowing tendency to be resisted, at least to some extent.

A second board 29 is fitted to the first board 27, by engaging the tongue 30 of one into the groove 28 of the other, and then a second series of clips 11 is engaged with the channels and with the groove 31 of the second board 29 as indicated in the upper part of FIG. 3.

In engaging the second board 29 with the first board 27 it is convenient for the upper edge of the board 29 to be held away from the channels to some extent while the tongue 30 is engaged with the mouth of the groove 28. Thereafter the upper edge of the board 29 is pushed back against the channels, and in the latter action the lower inner face of the board 29 is held away from the channel by the thickness of the main body 14 and there is a tendency for it, and the lower clips, to pivot about the upper edges of the main bodies 14, thereby increasing the pressure of the edges 21 and points 22 of those clips against the inner faces of the flanges 26. Thus the effect of the lower clips, against rising of the inner board is increased. This effect is markedly increased by reason of the curvature in the cross-piece 16, which curvature is straightened resiliently with the final movement of the board 29.

After positioning the board 29 and holding it by the clips 11 in its groove 31, a further board 32 is applied and the procedure is repeated until all the boards are placed. Thus the panelling procedure is concluded.

It will be evident that the invention provides a simple and effective means for erecting panelling and that in the finished job the boards are held properly in relation to each other, without distortion and without the channels or clips being visible when the panelling is completed. If it is desired to remove or replace one or more boards this can be done by proceeding in the reverse manner.

The channel members 23 are preferably provided with holes at appropriate positions in the web, whereby they can be fixed in position by screws or the like. Instead of being manufactured from a plastics material the channel members may be made of metal such as thin steel plate. In that case the appropriate surfaces of the flanges 26 may be roughened or serrated in order to ensure that the edges 21 and points 22 of the clips 11 will engage satisfactorily against the surfaces and not slip.

If desired, the slots 19 may be widened except at their commencement, so that the points 22 extend beyond the remainder of the edges 21 and perform the major part of the gripping engagement, or the edges 21 may be serrated or otherwise provided with a plurality of points.

I claim:

1. A clip for securing tongue and groove panel members to a supporting structure, the structure having a channel with re-entrant flanges, said clip being formed of resilient sheet metal and comprising a main body part to face against the outer faces of the re-entrant flanges of said channel, a plate extending out of the plane of the main body part and joined to the main body part by a central neck enabling the plate to be engaged within the channel with the neck between the re-entrant flanges thereof, said plate being severed from a central portion of said main body part whereby said body part has a pair of generally parallel sides joined at their ends by a cross bar, said sides being spaced to seat against the re-entrant flanges, said plate having tabs, one at each end to engage against the inner faces of the re-entrant flanges, a platform integral with the main body and projecting at right angles thereto in the direction opposite from the plate to extend between the mating edges of two tongue and groove panels, and at least one finger integral with the platform for insertion into the groove of one of the panels and between the tongue and groove of the interengaged panels, said main body part including means offset out of the general plane of the main body part in the same direction as the platform and arranged to be deflected toward the general plane of the main body part by compression between the channel and back surface of a panel for aligning the outer surfaces of two adjacent panels.

2. A clip for securing tongue and groove interlocking panel-like members to a supporting structure having a C-shaped channel with re-entrant flanges, said clip of resilient sheet metal comprising a main body part for seating against the outer faces of the re-entrant flanges of the channel, a plate integral with and extending out of the plane of the main body part at a substantial angle and of a width to be received between the re-entrant flanges, said plate being severed from a central portion of said main body part whereby said body part has a pair of generally parallel sides joined at their ends by a cross bar, said sides being spaced to seat against the re-entrant flanges, said plate having a tab at each end to engage against the inner faces of the re-entrant flange, a platform integral with the main body and projecting at a right angle thereto oppositely from the plate to seat between the mating edges of two tongue and groove panel members, at least one finger integral with the platform to seat within the groove and between the tongue and groove of a pair of the panel members, said cross bar being offset out of the general plane of the main body part in the same direction as the platform and arranged to be deflected toward the general plane of the main body part by compression between the channel and one of the panel members to positively urge the one panel member to align about its tongue and groove interengagement with an adjacent panel member with which it is engaged whereby the bearing between the outer face of the tongue of one panel member with the outer wall of the groove of the other panel member controls the exterior surface alignment of the panel members.

3. A clip according to claim 1 wherein said offset means is the cross piece convexly bowed.

4. A clip for securing tongue and groove interlocking panel-like members to a supporting structure having a C-shaped channel with re-entrant flanges, said clip of resilient sheet metal comprising a main body part for seating against the outer faces of the re-entrant flanges of the channel, a T-shaped plate integral with and extending out of the plane of the main body with the leg of the "T" being of a width to be received between the re-entrant flanges, said plate being severed from a central portion of said main body part whereby said body part has a pair of generally parallel sides joined at their ends by a cross bar, said sides being spaced to seat against the re-entrant flanges, said plate having a tab at each end to engage against the inner faces of the re-entrant flange, a platform integral with the main body and projecting at a right angle thereto oppositely from the plate to seat between the mating edges of two tongue and groove panel members, at least one finger integral with the platform to seat within the groove and between the tongue and groove of a pair of the panel members, said cross bar being arched out of the general plane of the main body part in the same direction as the platform and arranged to be deflected toward the general plane of the main body part by compression between the channel and one of the panel members to positively urge the one panel member to align about its tongue and groove interengagement with an adjacent panel member with which it is engaged whereby the bearing between the outer face of the tongue of one panel member with the outer wall of the groove of the other panel member controls the exterior surface alignment of the panel members.

* * * * *